United States Patent [19]

Swanson

[11] 3,949,978

[45] Apr. 13, 1976

[54] COLLATOR FOR PRINTED SHEETS

[75] Inventor: Kermit E. Swanson, Naperville, Ill.

[73] Assignee: R. R. Donnelley & Sons Company, Chicago, Ill.

[22] Filed: Feb. 7, 1975

[21] Appl. No.: 547,984

Related U.S. Application Data

[62] Division of Ser. No. 370,522, June 15, 1973, Pat. No. 3,880,418.

[52] U.S. Cl. ..... 270/54

[51] Int. Cl.[2] ..... B65H 39/02

[58] Field of Search ..... 270/54, 55, 56; 271/100

[56] References Cited

UNITED STATES PATENTS

| | | | |
|---|---|---|---|
| 3,008,705 | 11/1961 | Heigel et al. | 270/54 |
| 3,087,721 | 4/1963 | McCain | 270/54 |
| 3,768,804 | 10/1973 | Swanson | 271/101 |

FOREIGN PATENTS OR APPLICATIONS

| | | | |
|---|---|---|---|
| 1,140,495 | 1/1969 | United Kingdom | 271/32 |

*Primary Examiner*—Robert W. Michell
*Assistant Examiner*—V. Millin
*Attorney, Agent, or Firm*—Wegner, Stellman, McCord, Wiles & Wood

[57] ABSTRACT

A collator of the inserter type is especially constructed to receive a shingled stream of printed sheets from a feeding apparatus such as that of U.S. Pat. No. 3,522,943 and to afford positive feed of printed sheets from the hopper to the gatherer chain. A hopper which holds a vertical stack of printed sheets is provided with stack control means which includes lifter hooks operated through a box cam mechanism.

2 Claims, 4 Drawing Figures

COLLATOR FOR PRINTED SHEETS

CROSS-REFERENCE TO RELATED APPLICATION

This application is a division of co-pending application Ser. No. 370,522 filed June 15, 1973, now U.S. Pat. 3,880,418, issued Apr. 29, 1975.

This application includes general drawings and a general description of a printed sheet feeding apparatus which is used with the present collator. The sheet feeding apparatus is described in detail and claimed in applicant's co-pending application Ser. No. 370,521, filed June 15, 1973 now U.S. Pat. 3,880,419, issued Apr. 29, 1975.

BACKGROUND OF THE INVENTION

Experience of applicant's assignee with sheet feeders of the type disclosed in U.S. Pat. No. 3,522,943 has shown that collators, and in particular inserters, require some modifications and improvements in order to adapt them for efficient operation with such a signature or sheet feeder, or with the sheet feeder of applicant's co-pending application heretofore referred to.

Signature or sheet feeders as disclosed in the patent are particularly designed for use with a collator having hoppers in which the sheets or signatures are horizontal or substantially so. There are prior art flat gatherers which have hoppers in which the sheets are horizontal, but the only inserter having such a hopper is Mueller U.S. Pat. No. 3,199,862. Prior art collators may employ lifter hooks as part of their stack control, but any such lifter hooks known to applicant have been driven by mechanisms which are subject to excessive wear and which are also extremely noisy when used in a high speed collator.

SUMMARY OF THE INVENTION

The principal object of the present invention is to provide a collator in which the sheet supply boxes have a greatly improved drive for the stack lifter hooks.

Yet another object of the invention is to provide a collator in which the lifter hook motion is provided by a box cam which greatly reduces wear in the mechanism and which is far less noisy than prior art lifter hook drives.

THE DRAWINGS

DETAILED DESCRIPTION OF THE INVENTION

Figure 1:
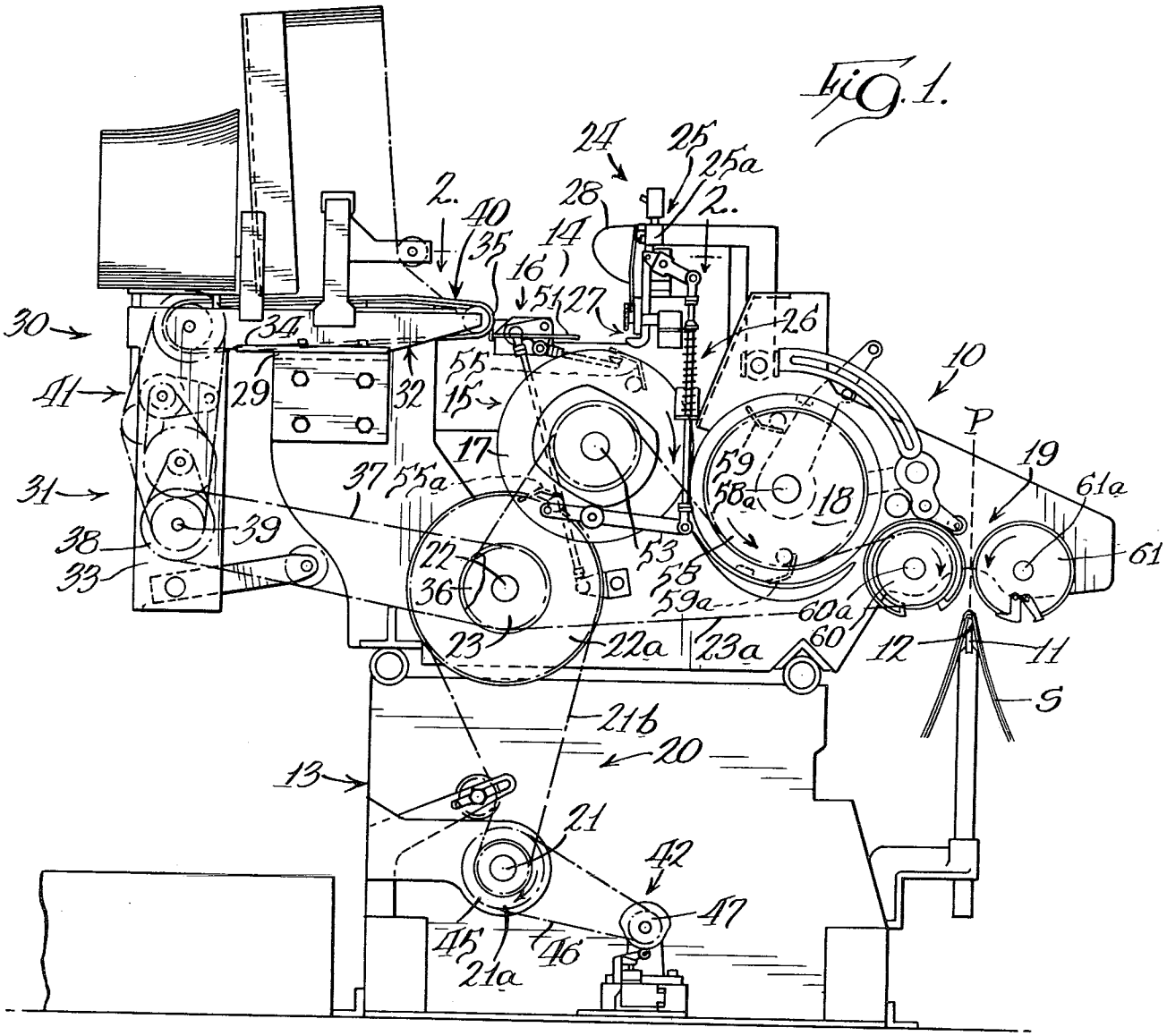
FIG. 1 is a somewhat schematic side elevational view of the collator of the present invention, with the sheet feeder of the co-pending application mounted thereon.

Referring to the drawings in detail, and referring first to FIG. 1, a collator has a series of printed sheet, or signature, supply and transfer boxes only one of which, indicated generally at 10, is illustrated in the drawings. The collator illustrated in the drawings is of the type which is commonly termed an inserter, and it has a conveyor chain 11 that extends along in front of the collator boxes 10 and is provided with spaced signature carriers 12 onto which opened signatures S are delivered from the boxes as the conveyor chain passes in front of them. In operation, each of the carriers 12 has an opened signature fed onto it from each of the boxes 10 so as to receive all the signatures required for a book, the book cover is fed onto the collated signatures at the last box, and the complete book passes to a saddle stitcher where it is bound by staples driven through the superimposed folded margins of the signatures which form the spine of the book.

The signature box 10 consists generally of a frame, indicated generally at 13, and surmounting frame 13 toward its front is a printed sheet hopper 14. Printed sheet delivery means, indicated generally at 15, includes a set of suction grippers 16, a pickup drum 17, a transfer drum 18 which is forward of the pickup drum, and a pair of opener rollers, indicated generally at 19, which are forward of the transfer drum 18 and flank the vertical median plane P of the carriers 12. Machine drive means, indicated generally at 20, includes a drive shaft 21 which extends through all the boxes 10 of the collator and is provided with drive sprockets 21*a*. A shaft 22 carries a sprocket 22*a* which is driven from the sprocket 21*a* by a chain 21*b*. Asheet transfer drive sprocket operates through a chain 23*a* to drive the sheet transfer means 15.

The printed sheet hopper 14 is adapted to contain a small stack of printed sheets or signatures S; and operatively associated with the hopper 14 is stack control means, indicated generally at 24, which includes stack height sensing means, indicated generally at 25, a stack lifter mechanism, indicated generally at 26, rotary corner brush means, indicated generally at 27, and a printed sheet front guide 28.

The inserter is particularly adapted for use with a signature feed apparatus, indicated generally at 30, by reason of the orientation of the signature hopper 14, and also by reason of the stack control means 24. Further, in order that the signature feed apparatus 30 may be mounted on the rear upper portion of the inserter 10, the machine frame 13 has parallel members with horizontal webs 29 on which the signature feed apparatus 30 rests so that it may be moved fore and aft on the inserter.

The signature feed apparatus 30 consists generally of a frame, indicated generally at 31, which is generally of an inverted L shape and includes a horizontal conveyor section 32 and a vertical drive section 33 which depends from the rear of the conveyor frame section 32. The conveyor frame section 32 has horizontal supporting plates 34 at its two sides which rest upon the horizontal webs 29 of the machine frame 13, and the front end 35 of the conveyor frame section 32 defines the rear of the hopper 14. As illustrated in FIG. 1, the signature feed apparatus 30 is in its most rearward position with its front end 35 approximately 10 inches from the front 14*a* of the hopper 14 to accommodate a maximum 9 ½ inch signature. By moving the feeder forward until the drive frame section 33 is substantially abutting the front of the machine frame 13 the length of the hopper can be reduced to function properly with a minimum signature, or printed sheet, of 3 ⅝ inches which is the size of many cards used as book inserts in saddle stitched books.

Further to accommodate the feed apparatus 30, the shaft 22 is provided with a sprocket 36 which is mounted alongside the sprocket 23 and is of the same size; and a drive chain 37 makes a driving connection between the sprocket 36 and an input sprocket 38 which is keyed to an input shaft 39 journalled near the bottom of the feed apparatus drive frame section 33. The sprocket 38 drives a conveyor mechanism, indicated generally at 40, and a jogger mechanism, indicated generally at 41.

Further cooperating with the feed apparatus 30 and with the stack height sensing means 25 is a pulsating switch means, indicated generally at 42, which is driven from a sprocket 45 on the main machine drive shaft 21 through a chain 46 and a sprocket 47.

DETAILED DESCRIPTION OF THE COLLATOR-INSERTER

Figure 2:
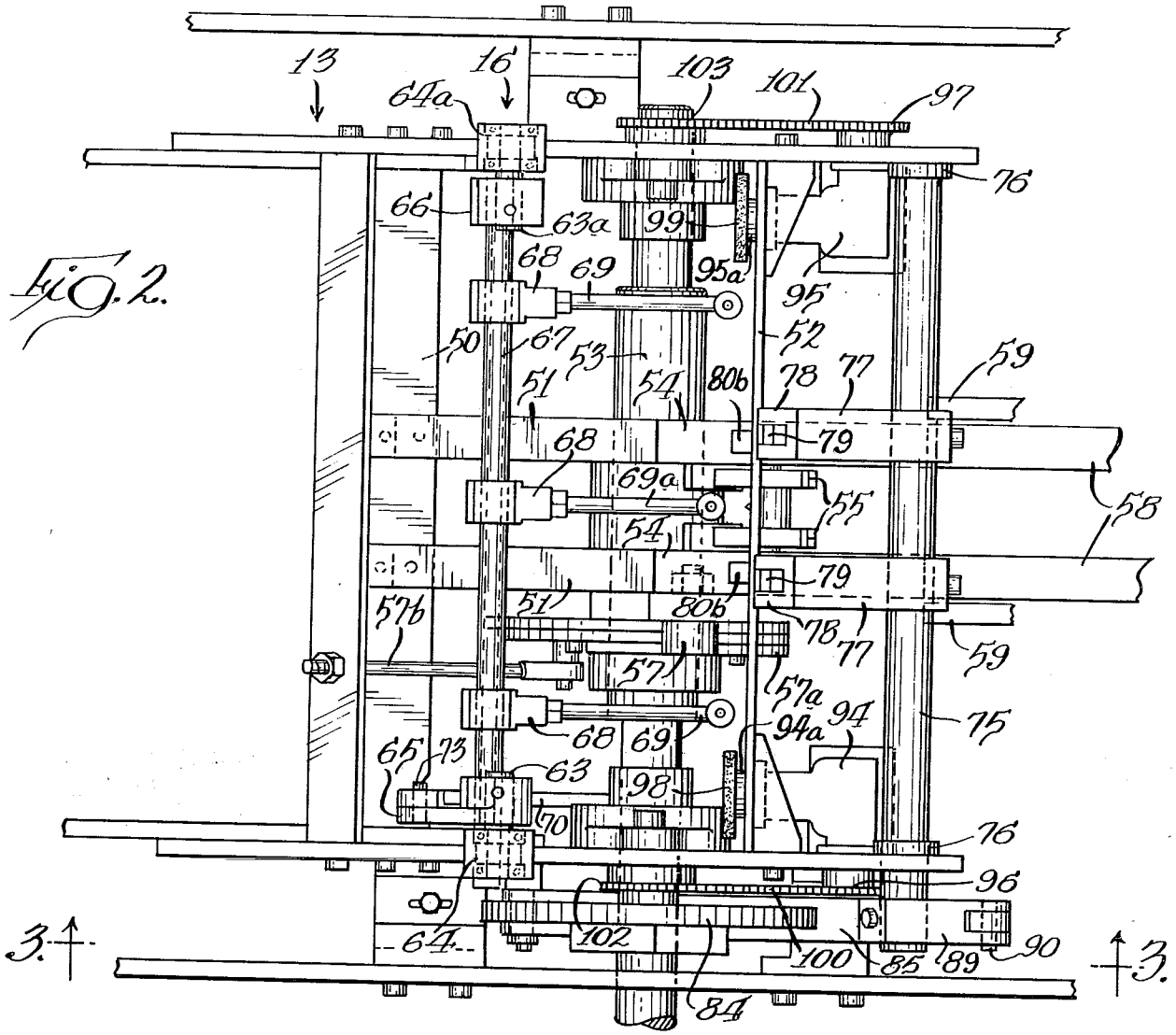
FIG. 2 is a fragmentary plan sectional view taken substantially as indicated along the line 2—2 of FIG. 1.
Figures 3, 4:
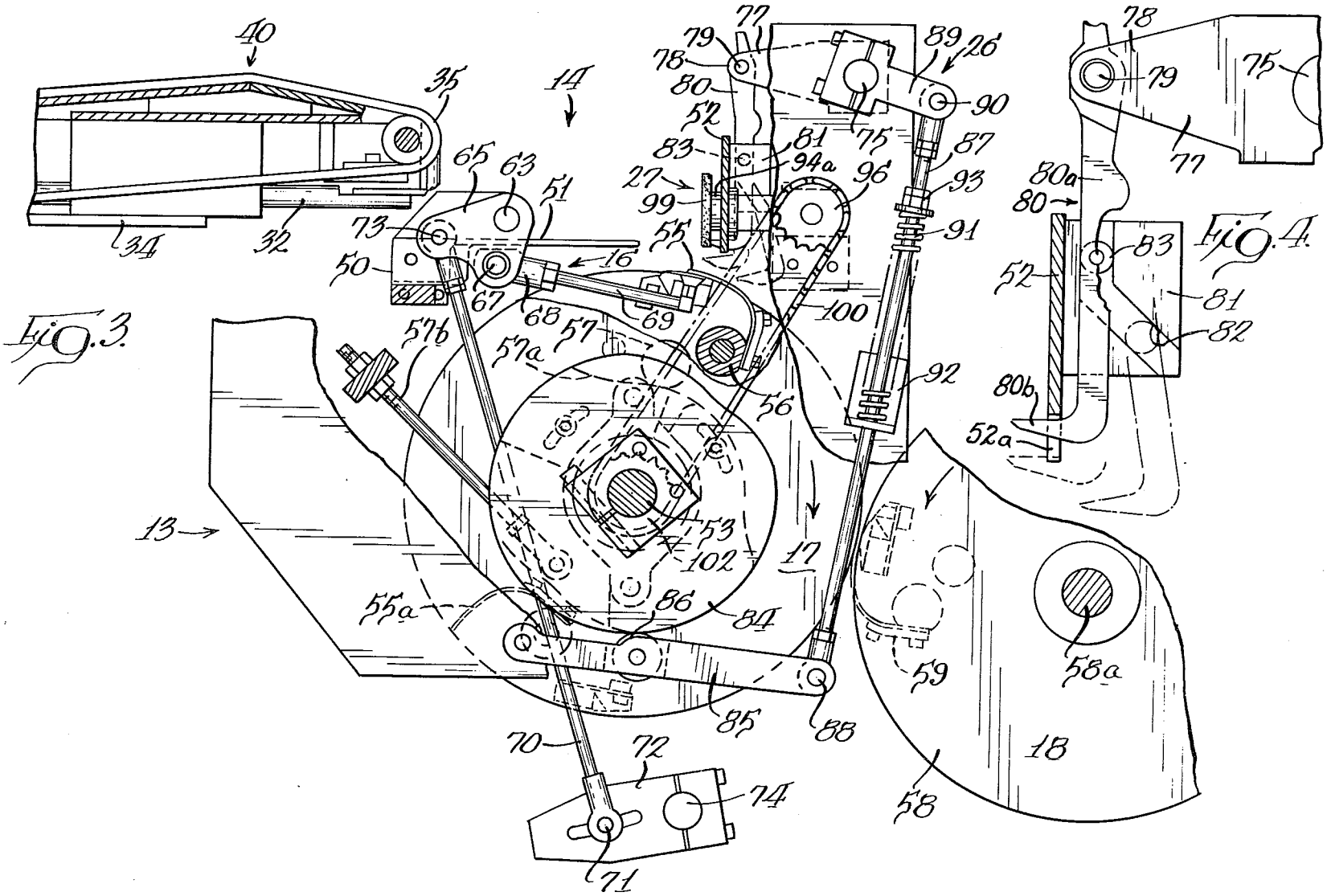
FIG. 3 is a fragmentary vertical sectional view taken substantially as indicated along the line 3—3 of FIG. 2.
FIG. 4 is a fragmentary detail on an enlarged scale of the stack lifter means in the sheet supply hopper of the collator.

Referring now particularly to FIGS. 2 and 3, the hopper 14 is seen to include a transverse saddle bracket 50 which is at the rear of the hopper and has a pair of parallel forwardly extending saddle members 51 which support the sheets or signatures in the hopper. A hopper front wall 52 takes the form of a transverse plate which is slotted at 52*a* for the stack lifter means 26 and apertured for the brush means 27.

The pickup drum 17 is mounted on a shaft 53, and is seen in FIG. 2 to comprise a pair of spaced drum members 54 which are directly beneath the saddle members 51. The drum members 54 are provided with grippers 55 and 55*a* which are illustrated, respectively, in a gripping and a release position, and which are seen in FIG. 2 to be between the drum members 54. Gripper rocker means such as the means 56 is operatively connected to a cam roller 57 (FIG. 2) which rides on a fixed cam 57*a* that is anchored by a tie-bar 57*b* to control movement of the grippers between the gripping and release positions. The grippers occupy the open position of 55*a* until they are clear of the leading edge of a sheet or signature pulled from the bottom of the stack by the suction gripper means 16, and then close rapidly upon the leading edge portion of said sheet or signature to draw it off the saddle members 51.

The transfer drum 18 consists of spaced drum discs 58 mounted upon a shaft 58*a*, and is provided with grippers 59 and 59*a* which are seen in FIG. 2 to be on the outside of the discs. The grippers 59 and 59*a* are cam controlled to occupy an open position until they reach the bight between the pickup drum 17 and the transfer drum 18, at which point they close simultaneously with the opening of the gripper 55 or 55*a*, so that the signature is released from the pickup drum 17 to the transfer drum 18.

The opener roller means 19 is seen in FIG. 1 to consist of a receiving roller 60 on a shaft 60*a* and a gripper roller 61 on a shaft 61*a*. Release of a signature from the transfer drum 18 to the receiving roller 60, and the opening of a signature by the rollers, is as described in Kleineberg U.S. Pat. No. 2,413,358.

Referring again to FIGS. 2 and 3, the suction gripper means 16 includes a pair of aligned, short rock shafts 63 and 63*a* which are supported, respectively, in bearing brackets 64 and 64*a* on the sides of the machine frame 13. A bell crank 65 is pinned to the short shaft 63; while an arm 66 is pinned to the shaft 63*a;* and between the bell crank and the arm is a suction pipe 67 upon which hollow suction arm brackets 68 are mounted. A pair of identical lateral tubular suction arm members 69 and a shorter central tubular suction arm member 69*a* are mounted in the suction brackets 68 so that movement of the bell crank 65 causes suction heads on the suction arm members to move between the position of FIG. 3 and an elevated position in which they engage the underside of the leading marginal portion of the lowermost signature in the hopper 14 and pull it down into the grip of the gripper 55 or 55*a* as the case may be. The suction pipe, brackets and tubular arms provide continuous conduit means; and means known to the art is used for applying suction to the suction heads as they approach their elevated position and for releasing the suction in timed relationship with the closing of the grippers 55 or 55*a*.

Movement of the bell crank 65 is provided by a connecting rod 70 which has its lower end connected at 71 for sliding movement with respect to a bracket 72, and which has its upper end pivotally connected at 73 to the bell crank 65. The bracket 72 is clamped on a rock shaft 74 to which rocking movement is imparted in any desired manner.

The signature pile lifter means 26 includes a rock shaft 75 which is journalled in bearings 76 on the sides of the machine frame 13, and a pair of lifter brackets 77 are fixedly connected to the rock shaft 75 and have bifurcated free ends 78 in which pins 79 pivotally support lifter hooks 80. The hooks have upright shanks 80*a* and rearwardly extending fingers 80*b* aligned with the slots 52*a* in the front wall.

As best seen in FIG. 4, box cams 81 are mounted on the forward side of the hopper front wall 52 and have cam tracks 82 in which cam rollers 83 on the stack lifters 80 ride. Thus, the stack lifter hooks are constrained to follow the path illustrated by the broken lines in FIG. 4 as the rock shaft 75 is rocked.

Rocking movement of the rock shaft is provided by a cam control which includes a cam disc 84 keyed to the shaft 53, a pivoted arm 85 carrying a follower roller 86 which rides on the cam disc 84, and a connecting rod 87 which is pivotally connected to the cam arm 85 at 88 and to a crank 89 on the rock shaft 75 at 90. Spring means 91 surrounding the connecting rod 87 bears upon a fixed spring abutment 92 and upon a spring collar 93 which is secured to the connecting rod 87 so as to constantly urge the linkage system in a direction which holds the follower roller 86 against the cam 84.

The stack corner brush means 27 is best seen in FIG. 2 to consist of right angle gear boxes 94 and 95 which are mounted on the side members of the frame 13 immediately forward of the front wall 52 of the hopper. Each of the right angle gear boxes 94 and 95 is supported in its respective frame side wall with sprockets 96 and 97, respectively, outside said walls. Output shafts 94*a* and 95*a* on the gear boxes extend horizontally and parallel to one another through holes in the front hopper wall 52 above the plane of the saddle members 51 (see FIG. 3) and carry circular brushes 98 and 99 which have radially extending bristles. The sprockets 96 and 97 of the gear boxes 94 and 95 are connected by drive chains 100 and 101, respectively, with drive sprockets 102 and 103 that are keyed to the pickup drum shaft 53 immediately outside the side members of the frame 13. The brushes 98 and 99 are so positioned that their inner periphery contact the head and foot of the sheets or signatures in the hopper close to their leading edges, and the brushes are rotated in a direction to bend said portions of the head and foot, and thus the leading edges, downwardly and help assure proper feeding of the lowermost signature in the stack by the suction members.

The spring member 28 consists of a length of spring steel about 2 inches wide which is mounted on the longitudinal median plane of the hopper in the position illustrated in FIG. 1. Thus, its upper end is secured adjacent a limit switch 25*a* of the pile height sensing means 25, and its lower end is secured approximately opposite the front end of the conveyor 40. The shape of the deflector member 28 is such that it forces the leading ends of all sheets or signatures entering the hopper 14 from the conveyor 40 downwardly, so that they cannot climb up the front wall 52 out of the reach of the suction members.

The timing of the stack lifters 80 is such that the lifters move into the space between the lowermost signature in the stack and the balance of the stack when the leading end portion of the lowermost signature is drawn down by the suction means; and the lifters 80 then move up to raise the leading end portion of the stack and relieve stack pressure on the lowermost sheet or signature so as to substantially eliminate the possibility that the sheet or signature will not be drawn properly into the grip of the grippers 55 or 55*a* and thus withdrawn from the stack for travel to the transfer drum 18 and the opener means 19.

The foregoing detailed description is given for clearness of understanding only and no unnecessary limitations should be understood therefrom, as modifications will be obvious to those skilled in the art.

I claim:

1. In a collator which includes an endless gathering chain provided with spaced carriers to deliver collated printed sheets for binding, and a series of printed sheet supply boxes aligned beside the conveyor chain for feeding printed sheets forwardly onto said carriers as the latter move past said boxes, in combination:

a supply box frame;

a hopper on top of said frame with horizontal support means to hold a small stack of generally horizontally disposed printed sheets, said hopper having a front wall provided with slots in its lower portion;

a plurality of stack lifter hooks each of which has an upright shank and a finger at the lower end of the shank, each of said hooks being pivotally suspended from its upper end forward of said front wall with its finger extending rearwardly in alignment with one of said slots;

means for simultaneously raising and lowering all of said hooks substantially endwise with no effective motion of said hooks toward said supply of box;

cam means including a follower roller on each hook shank and a cam track forward of the front wall having parallel surfaces between which each said roller is confined and travels as the hooks are raised and lowered, each said cam track and follower cooperating to modify said substantially endwise motion so as to project the hook finger rearwardly through the slot into engagement with the stack as the hook is raised and to retract the finger as the hook is lowered;

and gripper means beneath the hopper for engaging the bottom printed sheet in the stack near its leading edge to pull said sheet downwardly and forwardly out of the stack for feeding onto a conveyor chain carrier.

2. The combination of claim 1 in which each cam track has a lower and upper portion wherein said lower portion is inclined upwardly and rearwardly, and said upper portion is straight and upright and is connected to the top of said lower inclined portion.

* * * * *